US005193505A

United States Patent [19]

Straubel et al.

[11] Patent Number: 5,193,505

[45] Date of Patent: Mar. 16, 1993

[54] FUEL INJECTION PUMP FOR INTERNAL COMBUSTION ENGINES

[75] Inventors: Max Straubel, Stuttgart; Klaus Krieger, Affalterbach; Karl Konrath, Freiberg; Manfred Schwarz, Gerlingen, all of Fed. Rep. of Germany

[73] Assignee: Robert Bosch GmbH, Stuttgart, Fed. Rep. of Germany

[21] Appl. No.: 838,262

[22] PCT Filed: Aug. 31, 1990

[86] PCT No.: PCT/DE90/00661

§ 371 Date: Mar. 10, 1992

§ 102(e) Date: Mar. 10, 1992

[87] PCT Pub. No.: WO91/04409

PCT Pub. Date: Apr. 4, 1991

[30] Foreign Application Priority Data

Sep. 22, 1989 [DE] Fed. Rep. of Germany ..... 3931603

[51] Int. Cl.[5] ..... F02M 59/44; F02D 31/00

[52] U.S. Cl. ..... 123/366; 123/179.17

[58] Field of Search ..... 123/179.17, 366, 368, 123/365, 449, 503, 373

[56] References Cited

U.S. PATENT DOCUMENTS

| | | | |
|---|---|---|---|
| 3,640,259 | 2/1972 | Garcea | 123/366 |
| 3,727,598 | 4/1973 | Knapp | 123/179.17 |
| 3,847,127 | 11/1974 | Staudt | 123/366 |
| 3,865,091 | 2/1975 | Bostwick et al. | 123/366 |
| 3,938,487 | 2/1976 | Peltret | 123/179.17 |
| 4,109,629 | 8/1978 | Potter | 123/366 |
| 4,112,897 | 9/1978 | Hufendiek | 123/179.17 |
| 4,143,634 | 3/1979 | Ritter et al. | 123/368 |
| 4,204,510 | 5/1980 | Ritter et al. | 123/366 |
| 4,239,025 | 12/1980 | Konrath et al. | 123/179.17 |
| 4,253,438 | 3/1981 | Zibold | 123/366 |
| 4,254,753 | 3/1981 | Ritter et al. | 123/366 |
| 4,282,844 | 8/1981 | Skinner | 123/179.17 |
| 4,353,340 | 10/1982 | Straubel et al. | 123/365 |
| 4,387,688 | 6/1983 | Eheim | 123/179.17 |
| 4,604,977 | 8/1986 | Ohkoshi | 123/179.17 |
| 4,656,980 | 4/1987 | Ohkoshi | 123/179.16 |
| 4,665,873 | 5/1987 | Yogome et al. | 123/179.17 |
| 4,969,436 | 11/1990 | Hartmann et al. | 123/179.17 |

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A fuel injection pump for internal combustion engines which has a supply volume adjusting mechanism, being adjustable via a starting lever, an adjusting lever, and a tensioning lever. The starting lever is supported on the tensioning lever via a starting spring, and at non-operation of the engine, the starting spring is supported on a lever stop. To set the optimum amount of fuel to be injected at starting of the engine, which must be reduced at hot start, as opposed to a cold start, the lever stop is forcibly coupled with the adjusting lever such that the lever stop is moved by a swivel movement of the adjusting lever from a first end position to a second end position with the end positions being arranged so that the lever stop forces a starting lever position which in the first end position sets an amount of fuel on the supply volume adjusting mechanism as required for the hot start, and in the second end position, the lever stop sets an amount of fuel as required for the cold start.

17 Claims, 2 Drawing Sheets

FUEL INJECTION PUMP FOR INTERNAL COMBUSTION ENGINES

STATE OF TECHNOLOGY

The invention is based on a fuel injection pump for internal combustion engines of the type defined hereinafter.

To avoid any fume bursts from the exhaust on hot start, it is necessary with Diesel engines to reduce the amount of fuel which the fuel injection pump has metered for a cold start.

To overcome this problem, in a known fuel injection pump of the aforementioned type (DE 28 44 910 A1) the lever stop which determines the start position of the starting lever is displaced, depending on the temperature of the internal combustion engine, so that as the temperature rises, it shifts the starting lever in the direction of the setting for smaller fuel injection volumes. The supply volume adjusting mechanism, which is moveable on the fuel injection pump plunger, moves in relation to the starting lever position, this mechanism determines the amount of the plunger stroke, and hence the apportioned volume of injected fuel. The lever stop is moved by means of an expansion device controller, which projects into a chamber through which the engine cooling water flows and which engages the lever stop via a Bowden cable. When the engine is hot, the lever stop can be set to only one position, which corresponds to the full load position, but not lower than this position. This means that the warm start will not be entirely free from exhaust fume bursts. Moreover, such an adjusting device is fairly elaborate technically, and requires considerable additional costs in its manufacture.

ADVANTAGES OF THE INVENTION

In contrast, the fuel injection pump of the invention with the features set forth has an advantage that the different volumes required for hot and cold starts, can be set with very little effort. This simply requires a gear-type linkage between the adjusting lever and lever stop, such that by the swivelling movement of the adjusting lever, which is actuated by the accelerator pedal, the lever stop is moved from one end position to the other. Depending on the starting conditions (cold or hot start), the driver must, or must not, actuate the accelerator pedal, so that the starting lever will always assume the correct end position.

Further advantageous developments and improvements of the fuel injection pump described are possible through the actions listed hereinafter. Where in accordance with a preferred embodiment of the invention the lever stop is coupled with the adjusting lever in such a way that with a non-actuated adjusting lever, it assumes the first end position, then a starting sequence which is logical to the driver, is achieved: if the engine is cold, the driver must actuate the accelerator pedal, if the engine is hot, he must not actuate the accelerator pedal.

According to an embodiment of the invention, the coupling between lever stop and the adjusting lever is effected by means of a setting lever which is located torsionally rigid on the rocking shaft of the lever stop, and is actuated by the adjusting lever. The two end positions of the lever stop are determined by fixed stops in the swivel path of the setting lever. This has the advantage that the adjusting lever located outside the pump housing can be easily coupled with the lever stop which is arranged in the pump housing, without interference with the pump housing. The setting lever is also arranged outside the pump housing.

According to a further embodiment of the invention, the setting lever is articulated on the adjusting lever via a spring damped linkage. This has the advantage that the end positions of the setting lever and of the lever stop, respectively, and hence the start positions of the starting lever, can be set independently of the adjustment path of the adjusting lever. When the accelerator pedal is actuated, irrespective of the amount of pedal movement, then, after a minimum swivel movement of the adjusting lever, the setting lever will be in contact with the stop which defines the second end position, and it will retain this position even during further swivel movement of the adjusting lever.

For adjustment of the desired fuel starting volume, according to a further embodiment of the invention, the two stops of the adjusting lever are designed on adjusting screws in such a way that the end positions can be set with high accuracy.

DRAWING

An embodiment example of the invention is shown in the drawing and is described below in more detail. The drawing shows in:

FIG. 1 a section of a side view of a fuel injection pump, and

FIG. 2 a top view of the fuel injection pump in FIG. 1.

DESCRIPTION OF THE EMBODIMENT EXAMPLE

Figure 1:
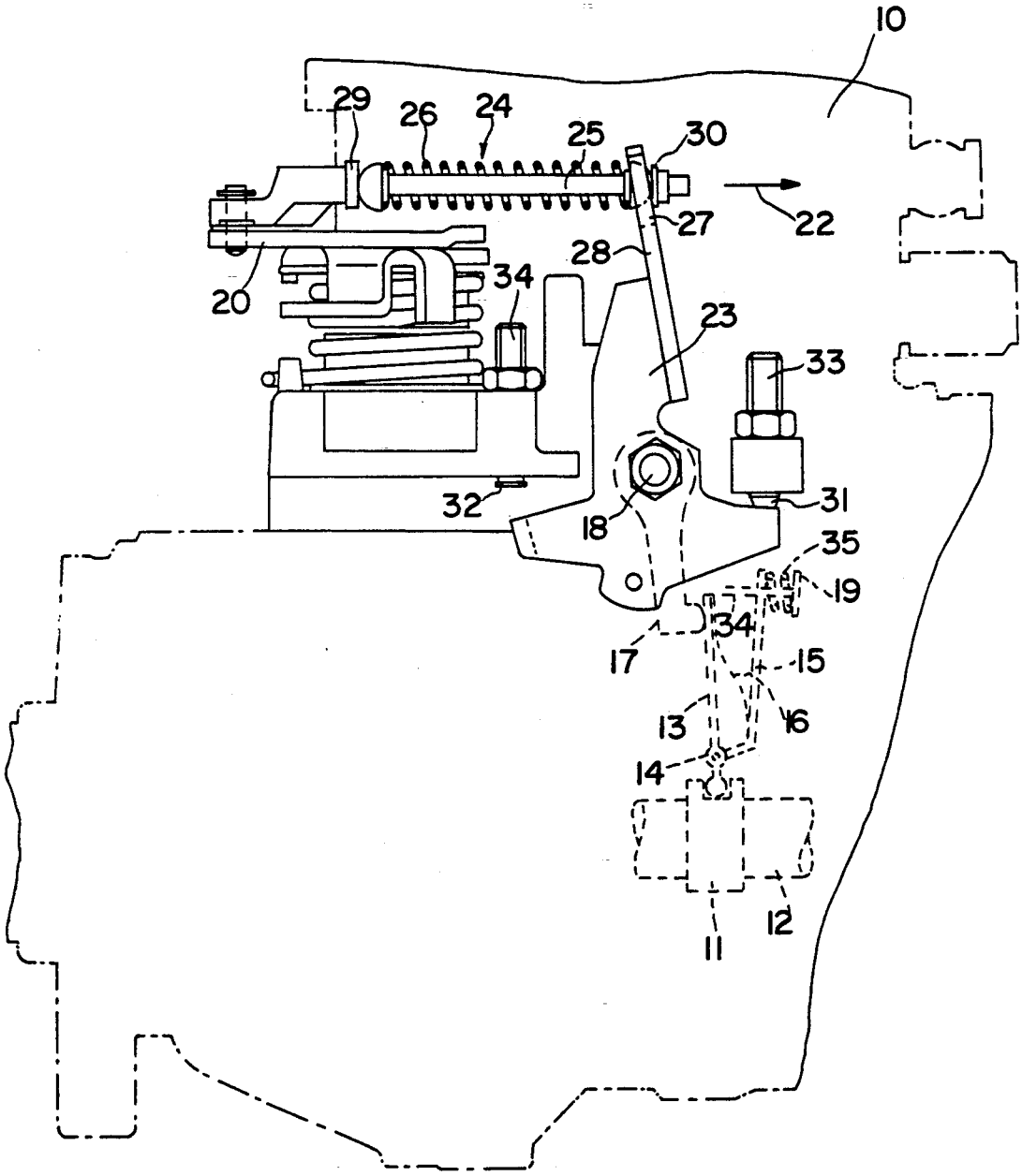
Figure 2:
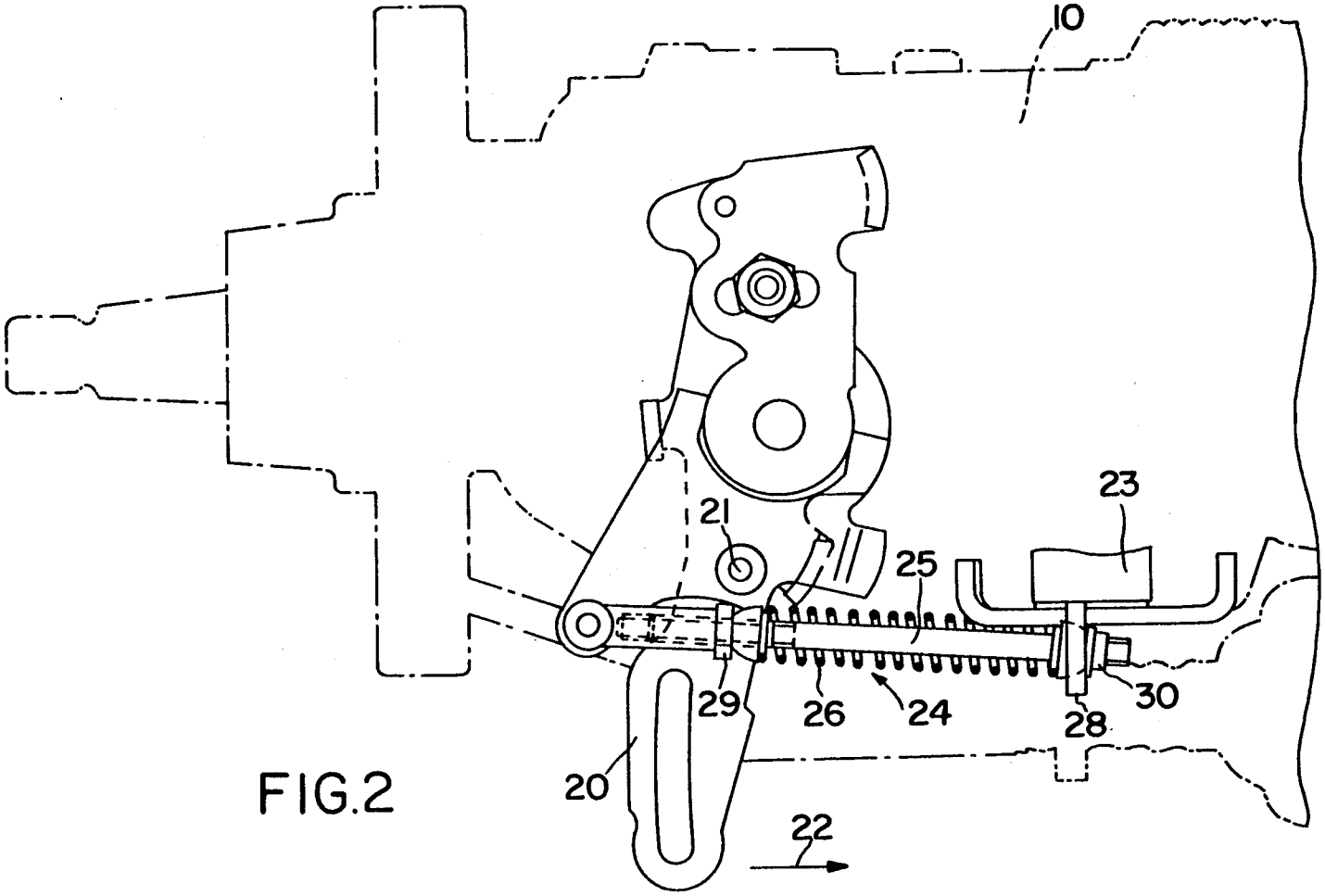

In the sectional view of the fuel injection pump, shown in side and top elevation, the pump housing is indicated by a dash-dot line and is numbered 10. The internal construction of the fuel injection pump is known and described, for example in the DE 28 44 910 A1. Of the components arranged inside the pump housing 10, only those shown by a dash-dot line are needed for the full comprehension of the invention, namely a delivery volume adjusting mechanism 11, which is located axially movable on a pump plunger 12 and which closes a delivery orifice in the pump plunger 12, a two-arm starting lever 13 which is pivoted about an axis 14, this starting lever engaging on the pump plunger 12, a single-arm tensioning lever 15 which is pivoted about the axis 14, on which the starting lever 13 is supported via a starting spring 16, and a lever stop 17, which is located torsionally rigid on a shaft 18 mounted in the pump housing 10. When the engine is not operating, the tensioning lever 15 contacts the lever stop 17 via a tensioning spring 35 on a spring plate 19 of a controller linkage 34, which is only implied in the illustration, and the starting lever 13 contacts the same lever stop 17 under the effect of the starting spring 16. Although not shown in detail, the tensioning lever 15 is connected, via an idling and control spring and the controller linkage 34, with an adjusting lever 20 which is pivoted at point 21 on the outside of the pump housing 10 and which can be pivoted arbitrarily via the accelerator pedal in the direction of the arrow 22 (FIG. 2). With a non-actuated accelerator pedal, the adjusting lever 20 will assume its position shown in FIGS. 1 and 2. A further item not shown is the flyweight speed governor which is in contact with the starting lever 13 and which effects a shift of the delivery volume adjusting mechanism 11, via this starting lever and the tensioning lever 15, which is appropriate to the operating conditions of the internal combustion engine. The delivery volume adjusting mechanism 11 determines in a known way, the amount of fuel injected into the cylinders by the fuel injection pump, by virtue of the delivery orifice emerging from the delivery volume adjusting mechanism 11 after a pump plunger stroke which is governed by the position of the delivery volume adjusting mechanism, and a return flow is enabled for the fuel still present in the pump working chamber.

The shaft 18 projecting outwards from the pump housing 10 has a setting lever 23 connected to it, so as to be torsionally rigid on the outside of the pump housing 10, this lever 23 is coupled with the adjusting lever 20 via a spring damped linkage 24. This consists of a rod 25 which is eccentrically pivoted on the adjusting lever 20, and a helical compression spring 26 within which the rod 25 is concentrically enclosed. The rod 25 projects through a hole 27 on a lug 28 which is rigidly connected to the setting lever 23. The helical compression spring 26 which is supported against the rod 25 and on the annular shoulder 29 presses the lug 28 against a support ring 30 which is fixed to the rod 25. The swivel path of the setting lever 23 is restricted by two stops 31,32 which are seated on the adjusting screws 33,34 and can therefore be set with great accuracy following the final assembly of the fuel injection pump.

The setting lever 23 is coupled to the adjusting lever 20 in such a way that when the adjusting lever 20 is not operated, the setting lever 23 rests against the first stop 31, and when the adjusting lever 20 is moved over a small distance, lever 23 will come to rest against the second stop 32. With further movement of the adjusting lever 20 and the setting lever 23 resting against the second stop 32, the rod 25, under compression of the helical compression spring 26, can push through the lug 28 of the setting lever 23 so that the movement of the adjusting lever 20 is not restricted. When the setting lever 23 rests against the first stop 31, the lever stop 17, which is torsionally rigidly connected with the setting lever 23, assumes a first end position, as shown in FIG. 1. When the setting lever 23 rests against the second stop 32, the lever stop 17 is rotated in clockwise direction (FIG. 1) to the second end position. The starting lever 13 remains pressed against the lever stop 17 by the starting spring 16 and thus follows the movement of the lever stop 17. The movement of the starting lever 13 in turn effects a shift to the right of the supply volume adjusting mechanism 11 in FIG. 1, which means that the pump plunger 12 must cover a longer distance during the compression stroke, until the delivery orifice emerges from the supply volume adjusting mechanism 11. The fuel volume then injected by the pump plunger is significantly greater than that supplied with the position of the supply volume adjusting mechanism 11 as illustrated in FIG. 1. The stops 31,32 are now set by the adjusting screws 33,34 in such a way that in both its end positions, the lever stop 17 forces a start lever position which in the first end position (shown in FIG. 1) sets a fuel volume as required for the hot start, and in the second end position, sets a fuel volume as required for the cold start, these settings being made on the supply volume adjusting mechanism 11.

With a cold start, the driver must operate the accelerator pedal, whereby the adjusting lever 20 is rotated, which positions the setting lever 23 against the second stop 32. The supply volume adjusting mechanism 11 is moved and the fuel volume required for the cold start is set via the starting lever 13. With a hot engine start, the driver must not operate the accelerator pedal. The adjusting lever 20 thus assumes its basic setting, as presented in FIGS. 1 and 2, and the setting lever 23 rests against the first stop 31. The lever stop 17, which is in its first end position, causes the supply volume adjusting mechanism 11 to assume a sliding position on the pump plunger 12, via the starting lever 13. The reduced fuel requirement for the hot start is now conditioned by the position of the supply volume adjusting mechanism 11.

The foregoing relates to a preferred exemplary embodiment of the invention, it being understood that other variants and embodiments thereof are possible within the spirit and scope of the invention, the latter being defined by the appended claims.

We claim:

1. A fuel injection pump for internal combustion engines with a supply volume adjusting mechanism which determines the amount of fuel to be injected, a starting lever that acts on the supply volume adjusting mechanism in order to adjust it, said starting lever being supported on a tensioning lever via a starting spring, with an adjusting lever which is arbitrarily operable via an accelerator pedal and which is coupled with the tensioning lever, and with an adjustable lever stop, against which the starting lever rests, under the action of the starting spring, when the engine is not operating, the lever stop (17) is forcibly coupled with the adjusting lever (20), such that said lever stop (17) is moved by the swivelling movement of the adjusting lever (20) from its first end position into a second end position, and that the end positions are determined in such a way that the lever stop (17) forces a starting lever position, which in the first end position, sets a fuel volume at the supply volume adjusting mechanism (11), as required for a hot start, and in the second end position, it sets a fuel volume as required for a cold start of the engine.

2. A fuel injection pump in accordance with claim 1, in which the lever stop (17) assumes its first end position with a non-operated adjusting lever (20).

3. A fuel injection pump in accordance with claim 1, in which for the coupling between lever stop (17) and adjusting lever (20), the lever stop (17) is connected torsionally rigid with a setting lever (23) which is actuated by the adjusting lever (20), the rotational movement of the setting lever (23) being limited by two stops (31,32) which determine the end positions of the lever stop (17).

4. A fuel injection pump in accordance with claim 3, in which the setting lever (23) is pivoted on the adjusting lever (20) via a spring damped linkage (24).

5. A fuel injection pump in accordance with claim 3, in which the stops (31, 32) are arranged on adjusting screws (33, 34).

6. A fuel injection pump in accordance with claim 3, in which the setting lever (23) rests torsionally rigid on the swivel axis (18) of the lever stop (17) on the outside of the pump housing (10).

7. A fuel injection pump in accordance with claim 2, in which for the coupling between lever stop (17) and adjusting lever (20), the lever stop (17) is connected torsionally rigid with a setting lever (23) which is actuated by the adjusting lever (20), the rotational movement of the setting lever (23) being limited by two stops (31, 32) which determine the end positions of the lever stop (17).

8. A fuel injection pump in accordance with claim 7, in which the setting lever (23) is pivoted on the adjusting lever (20) via a spring damped linkage (24).

9. A fuel injection pump in accordance with claim 4, in which the stops (31, 32) are arranged on adjusting screws (33, 34).

10. A fuel injection pump in accordance with claim 7, in which the stops (31, 32) are arranged on adjusting screws (33, 34).

11. A fuel injection pump in accordance with claim 8, in which the stops (31, 32) are arranged on adjusting screws (33, 34).

12. A fuel injection pump in accordance with claim 4, in which the setting lever (23) rest torsionally rigid on the swivel axis (18) of the lever stop (17) on the outside of the pump housing (10).

13. A fuel injection pump in accordance with claim 7, in which the setting lever (23) rest torsionally rigid on the swivel axis (18) of the lever stop (17) on the outside of the pump housing (10).

14. A fuel injection pump in accordance with claim 8, in which the setting lever (23) rest torsionally rigid on the swivel axis (18) of the lever stop (17) on the outside of the pump housing (10).

15. A fuel injection pump in accordance with claim 9, in which the setting lever (23) rest torsionally rigid on the swivel axis (18) of the lever stop (17) on the outside of the pump housing (10).

16. A fuel injection pump in accordance with claim 10, in which the setting lever (23) rest torsionally rigid on the swivel axis (18) of the lever stop (17) on the outside of the pump housing (10).

17. A fuel injection pump in accordance with claim 11, in which the setting lever (23) rest torsionally rigid on the swivel axis (18) of the lever stop (17) on the outside of the pump housing (10).

* * * * *